US010495109B2

(12) United States Patent
Sakaguchi et al.

(10) Patent No.: US 10,495,109 B2
(45) Date of Patent: Dec. 3, 2019

(54) VACUUM PUMP AND HEAT INSULATING SPACER USED IN VACUUM PUMP

(71) Applicant: Edwards Japan Limited, Yachiyo-shi, Chiba (JP)

(72) Inventors: Yoshiyuki Sakaguchi, Yachiyo (JP); Norihiro Kurokawa, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 500 days.

(21) Appl. No.: 15/116,716

(22) PCT Filed: Jan. 8, 2015

(86) PCT No.: PCT/JP2015/050315

§ 371 (c)(1),
(2) Date: Aug. 4, 2016

(87) PCT Pub. No.: WO2015/122215

PCT Pub. Date: Aug. 20, 2015

(65) Prior Publication Data

US 2016/0348695 A1 Dec. 1, 2016

(30) Foreign Application Priority Data

Feb. 14, 2014 (JP) ..... 2014-026415

(51) Int. Cl.
*F04D 29/58* (2006.01)
*F04D 19/04* (2006.01)
(Continued)

(52) U.S. Cl.
CPC ..... *F04D 29/5853* (2013.01); *F04D 19/042* (2013.01); *F04D 19/044* (2013.01);
(Continued)

(58) Field of Classification Search
CPC .... F04D 29/5853; F04D 19/04; F04D 19/042; F04D 19/044
(Continued)

(56) References Cited

U.S. PATENT DOCUMENTS 4,797,062 A 1/1989 Deters et al.
5,618,167 A * 4/1997 Hirakawa ..... F04D 19/04 417/372
(Continued)

FOREIGN PATENT DOCUMENTS

JP H074384 A 1/1995
JP H09310696 A 12/1997
(Continued)

OTHER PUBLICATIONS

International Search Report dated Apr. 14, 2015 for corresponding PCT Application No. PCT/JP2015/050315.
(Continued)

*Primary Examiner* — Jason D Shanske
*Assistant Examiner* — Aye S Htay
(74) *Attorney, Agent, or Firm* — Westman, Champlin & Koehler, P.A.; Theodore M. Magee

(57) ABSTRACT

Provided is a vacuum pump for preventing solidification of gas in a thread groove portion, and a heat insulating spacer used in the vacuum pump. The vacuum pump includes a heat insulating spacer that is interposed between a casing and an outer circumferential stator having a thread groove portion, supports the outer circumferential stator coaxially with a rotor in a rotor radial direction, with keeping a gap between the casing and the outer circumferential stator, and has lower thermal conductivity than the casing and the outer circumferential stator.

11 Claims, 4 Drawing Sheets

(51) Int. Cl.

| | |
|---|---|
| ***F04D 29/32*** | (2006.01) |
| ***F04D 29/52*** | (2006.01) |
| ***F04D 29/54*** | (2006.01) |

(52) U.S. Cl.
CPC ..... *F04D 29/32* (2013.01); *F04D 29/522* (2013.01); *F04D 29/542* (2013.01); *F05D 2230/642* (2013.01); *F05D 2260/607* (2013.01)

(58) Field of Classification Search
USPC ..... 417/423.4
See application file for complete search history.

(56) References Cited

U.S. PATENT DOCUMENTS

| | | | | |
|---|---|---|---|---|
| 5,924,841 | A | 7/1999 | Okamura | |
| 2002/0039533 | A1* | 4/2002 | Miyamoto | F04D 19/04 417/313 |
| 2002/0090309 | A1* | 7/2002 | Yamashita | F04D 19/04 417/423.4 |
| 2005/0249618 | A1* | 11/2005 | Nonaka | F04D 19/04 417/423.4 |
| 2012/0034066 | A1* | 2/2012 | Kogame | F04D 19/042 415/90 |

FOREIGN PATENT DOCUMENTS

| | | | |
|---|---|---|---|
| JP | 2001032789 | A | 2/2001 |
| JP | 2002303293 | A | 10/2002 |
| JP | 2003278692 | A | 10/2003 |
| JP | 2006037951 | A | 2/2006 |

OTHER PUBLICATIONS

International Written Opinion dated Apr. 14, 2015 for corresponding PCT Application No. PCT/JP2015/050315.
Communication dated Aug. 16, 2017 and Supplementary European Search Report dated Aug. 8, 2017 for corresponding European Application No. EP15748924.

* cited by examiner

VACUUM PUMP AND HEAT INSULATING SPACER USED IN VACUUM PUMP

CROSS-REFERENCE TO RELATED APPLICATION

This Application is a Section 371 National Stage Application of International Application No. PCT/JP2015/050315, filed Jan. 8, 2015, which is incorporated by reference in its entirety and published as WO 2015/122215 A1 on Aug. 20, 2015 and which claims priority of Japanese Application No. 2014-026415, filed Feb. 14, 2014.

BACKGROUND OF THE INVENTION

1. Field of the Invention

The present invention relates to a vacuum pump and a heat insulating spacer used in this vacuum pump. More particularly, the present invention relates to a vacuum pump that can be used in a pressure range between low vacuum pressure and super high vacuum pressure, and a heat insulating spacer used in this vacuum pump.

2. Description of the Related Art

In manufacturing semiconductor devices such as memories and integrated circuits, a high-purity semiconductor substrate (wafer) needs to be subjected to doping and etching in a high-vacuum chamber for the purpose of avoiding the impacts of dust and the like in the air, and a vacuum pump such as a turbomolecular pump is used for evacuation of the chamber.

As this type of a vacuum pump, there has been known a vacuum pump that has a cylindrical casing, a cylindrical stator that is fixed to the inside of the casing by means of an insert, and has a thread groove portion disposed therein, a rotor supported in the stator so as to be rotatable at high speed, and heating means for keeping the temperature of the casing to a predetermined level or higher (see Japanese Patent Application Publication No. 2003-278692, for example).

In this vacuum pump, as shown in FIG. 4, the temperature of a rotor 101 and the temperature of a stator 102 surrounding the rotor 101 are increased by the heat of the rotor 101 and the heat of a drive motor, not shown, for rotating the rotor 101, and also a casing 103 is forcibly heated from the outside by means of heating means, not shown, during the operation of the vacuum pump 100, whereby the gas transferred through a thread groove portion 104 while being compressed is prevented from solidifying and depositing in the thread groove portion 104.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

However, in the foregoing vacuum pump, as shown in FIG. 4, the stator 102 is supported by the casing 103 in a rotor radial direction R perpendicular to the rotating shaft of the rotor 101 in such a manner that the stator 102 is positioned coaxially with the rotor 101. Such a configuration allows the heat of the stator 102 to escape to the casing 103 cooler than the stator 102, through the contact portion C between the stator 102 and the casing 103, making it difficult to keep the temperature of the stator 102 at a desired level or higher.

As the temperature of the stator 102 increases, the stator 102 becomes thermally expanded and enlarged in the direction of the arrow shown in FIG. 4, bringing the stator 102 and the casing 103 into contact with each other at high contact pressure and significantly lowering the thermal resistance on the contact surface between the stator 102 and the casing 103. Consequently, the heat from the stator 102 escapes to the casing 103 more easily.

The escape of the heat of the stator 102 to the casing 103 leads to a decrease in the temperature of the stator 102 to fall below the sublimation point of the gas. As a result, the gas compressed to high pressure, which is transferred through the thread groove portion 104, solidifies and accumulates, narrowing the gas flow channel and deteriorating the compression performance and evacuation performance of the vacuum pump 100.

These circumstances raise technical problems that need to be solved in order to prevent the solidification of the gas in the thread groove portion, and an object of the present invention is to solve these problems.

The present invention has been proposed in order to achieve the foregoing object. The invention described in claim 1 is a vacuum pump, having: a casing; a rotor that is supported rotatably in the casing and has a rotor cylinder portion; a stator having a substantially cylindrical shape, disposed coaxially with the rotor between the casing and the rotor cylinder portion; a thread groove portion engraved on either an outer circumferential surface of the rotor cylinder portion or an inner circumferential surface of the stator; and a heat insulating spacer that is interposed between the casing and the stator, supports the stator in a rotor radial direction, with keeping a gap between the casing and the stator, and has lower thermal conductivity than at least either the casing or the stator.

According to this configuration, the stator is supported in the rotor radial direction by the heat insulating spacer having low thermal conductivity. Therefore, the stator is supported indirectly by the casing in the rotor radial direction, preventing the heat of the stator from escaping to the casing.

Furthermore, the heat insulating spacer supports the stator in the rotor radial direction, with a gap ensured between the stator and the casing. Therefore, even in a case where the stator becomes thermally expanded and enlarged, the stator can be prevented from pressing the casing strongly, inhibiting the escape of the heat of the stator, which is attributed to a significant decrease in contact resistance between the stator and the casing.

The invention described in claim 2 provides a vacuum pump, which, in addition to the configuration of the vacuum pump described in claim 1, has a configuration in which the heat insulating spacer supports the stator also in a rotor axial direction.

According to this configuration, the stator is supported by the casing in the rotor radial direction and the rotor axial direction, via the heat insulating spacer having low thermal conductivity. This configuration allows the stator to be stored in the casing in the rotor radial direction and the rotor axial direction without coming into direct contact with the casing, further preventing the escape of the heat of the stator.

The invention described in claim 3 provides a vacuum pump, which, in addition to the configuration of the vacuum pump described in claim 1 or 2, has a configuration in which the casing has a cylinder portion and a base provided under the cylinder portion, and the heat insulating spacer has an axial supporting portion having a substantially cylindrical shape, extended along a rotor axial direction and interposed between the base and a flange provided circumferentially on an outer circumferential surface of the stator, a first radial supporting portion provided circumferentially on an outer circumferential surface of the axial supporting portion and coming into contact with an inner circumferential surface of the casing, and a second radial supporting portion provided circumferentially on an inner circumferential surface of the axial supporting portion and coming into contact with the outer circumferential surface of the stator.

According to this configuration, the axial supporting portion supports the stator in the rotor axial direction, and the first and second radial supporting portions support the stator in the rotor radial direction. Such a configuration allows the stator to be stored in the casing via the heat insulating spacer having low thermal conductivity, without coming into direct contact with the casing, preventing the escape of the heat of the stator.

The invention described in claim 4 provides a vacuum pump, which, in addition to the configuration of the vacuum pump described in claim 3, has a configuration in which the first radial supporting portion is disposed on one end side of the axial supporting portion, and the second radial supporting portion is disposed on the other end side of the axial supporting portion.

According to this configuration, the heat transfer path inside the heat insulating spacer is lengthened, further preventing the escape of the heat of the stator.

The invention described in claim 5 provides a vacuum pump, which, in addition to the configuration of the vacuum pump described in claim 3 or 4, has a configuration in which the axial supporting portion is formed to have lower rigidity than the first radial supporting portion and bends in the rotor radial direction in response to thermal expansion of the stator.

According to this configuration, the axial supporting portion can bend toward the outside in the rotor radial direction in response to thermal expansion of the stator. Therefore, even in a case where the stator becomes thermally expanded and enlarged, such a configuration can prevent the escape of the heat of the stator, which is attributed to excessive adhesion between the stator and the second radial supporting portion and thus a significant decrease in contact resistance between the stator and the heat insulating spacer.

The invention described in claim 6 provides a vacuum pump, which, in addition to the configuration of the vacuum pump described in any one of claims 3 to 5, has a configuration in which one end of the axial supporting portion is stretched farther downward from the first radial supporting portion in the rotor axial direction and comes into contact with the base.

According to this configuration, stretching the axial supporting portion farther downward from the first radial supporting portion in the rotor axial direction, ensures a gap between the base and the first radial supporting portion, bringing the first radial supporting portion and the base into contact with each other by a reduced area and further preventing the escape of the heat of the stator.

The invention described in claim 7 provides a heat insulating spacer that is used in the vacuum pump described in any one of claims 1 to 6.

According to this configuration, the heat insulating spacer having lower thermal conductivity than the stator and the casing can support the stator in the rotor radial direction while preventing the heat of the stator from escaping to the casing and ensuring a gap between the stator and the casing. Such a configuration can prevent the heat of the stator from escaping to the casing.

The vacuum pump according to the present invention can prevent the heat of the stator from escaping to the casing and thereby prevent the temperature of the stator from dropping to the sublimation point of the gas or lower, the gas being transferred through the thread groove portion. In this manner, the gas can be prevented from solidifying in the thread groove portion.

The heat insulating spacer according to the present invention can prevent the heat of the stator from escaping to the casing and thereby prevent the temperature of the stator from dropping to the sublimation point of the gas or lower, the gas being transferred through the thread groove portion. In this manner, the gas can be prevented from solidifying in the thread groove portion.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

FIG. 2 is a diagram of a heat insulating spacer shown in FIG. 1, wherein FIG. 2A is a plan view, FIG. 2B a cross-sectional view taken along IIB of FIG. 2A, and FIG. 2C an enlarged cross-sectional view showing substantial portions of FIG. 2B;

FIG. 3 is a schematic diagram for explaining the actions of the heat insulating spacer of the vacuum pump shown in FIG. 1, wherein FIG. 3A is a diagram showing a state obtained prior to thermal expansion of an outer circumferential stator, and FIG. 3B a diagram showing a stat obtained after thermal expansion of the outer circumferential stator.

DESCRIPTION OF THE PREFERRED EMBODIMENTS

In order to achieve the object of preventing solidification of gas in a thread groove portion, the present invention was realized by a vacuum pump that has: a casing; a rotor that is supported rotatably in the casing and has a rotor cylinder portion; a stator having a substantially cylindrical shape, disposed coaxially with the rotor between the casing and the rotor cylinder portion; a thread groove portion engraved on either an outer circumferential surface of the rotor cylinder portion or an inner circumferential surface of the stator; and a heat insulating spacer that is interposed between the casing and the stator, supports the stator in a rotor radial direction, with keeping a gap between the casing and the stator, and has lower thermal conductivity than at least either the casing or the stator.

In order to achieve the object of preventing solidification of gas in the thread groove portion, the present invention was realized by a heat insulating spacer that is used in a vacuum pump having: a casing; a rotor that is supported rotatably in the casing and has a rotor cylinder portion; a stator having a substantially cylindrical shape, disposed coaxially with the rotor between the casing and the rotor cylinder portion; and a thread groove portion engraved on either an outer circumferential surface of the rotor cylinder portion or an inner circumferential surface of the stator, wherein the heat insulating spacer is interposed between the casing and the stator, supports the stator in a rotor radial direction, with keeping a gap between the casing and the stator, and has lower thermal conductivity than the casing and the stator.

Embodiments

Figure 1:
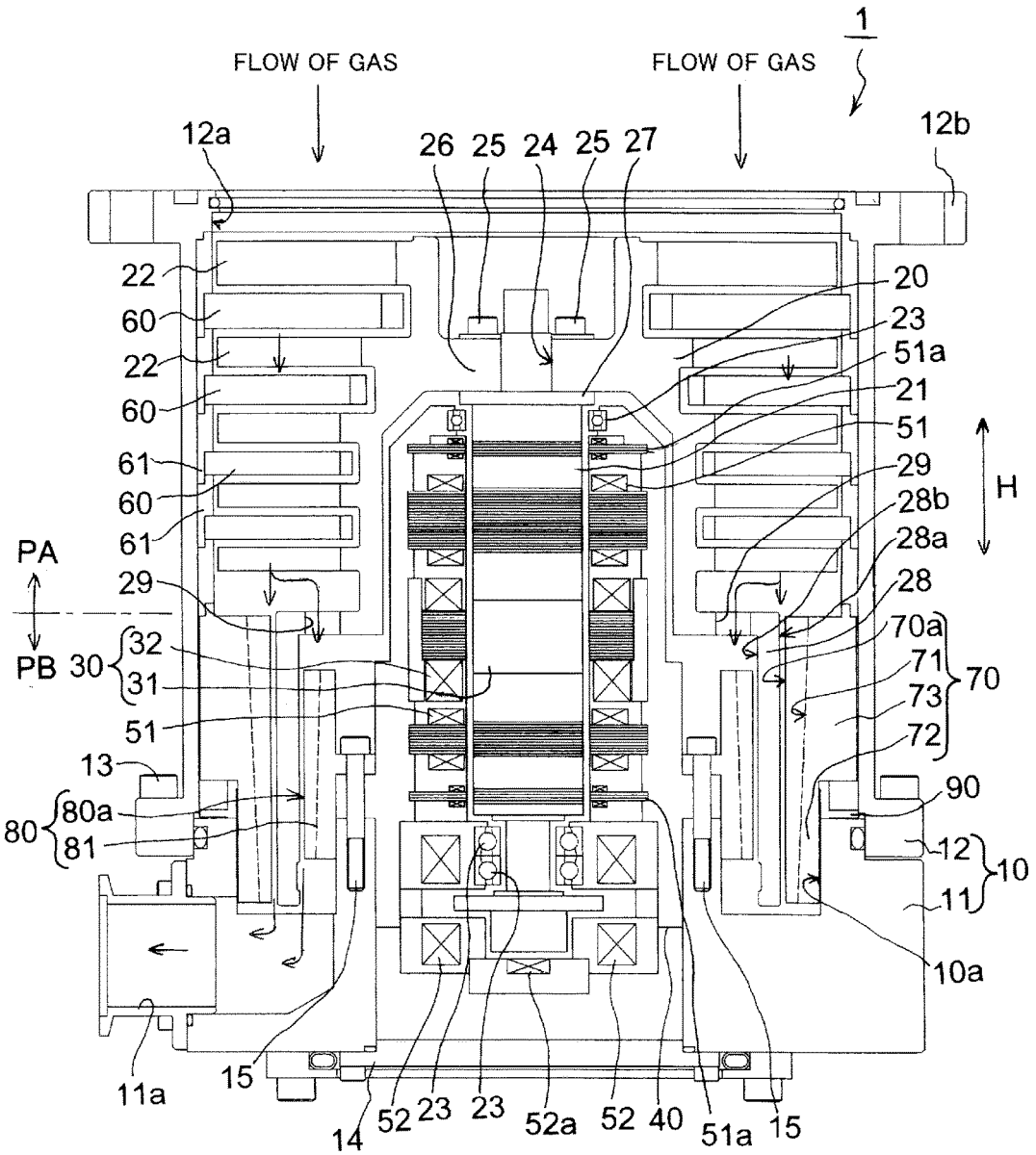
FIG. 1 is a cross-sectional view showing a vacuum pump according to an embodiment of the present invention.
Figure 2:
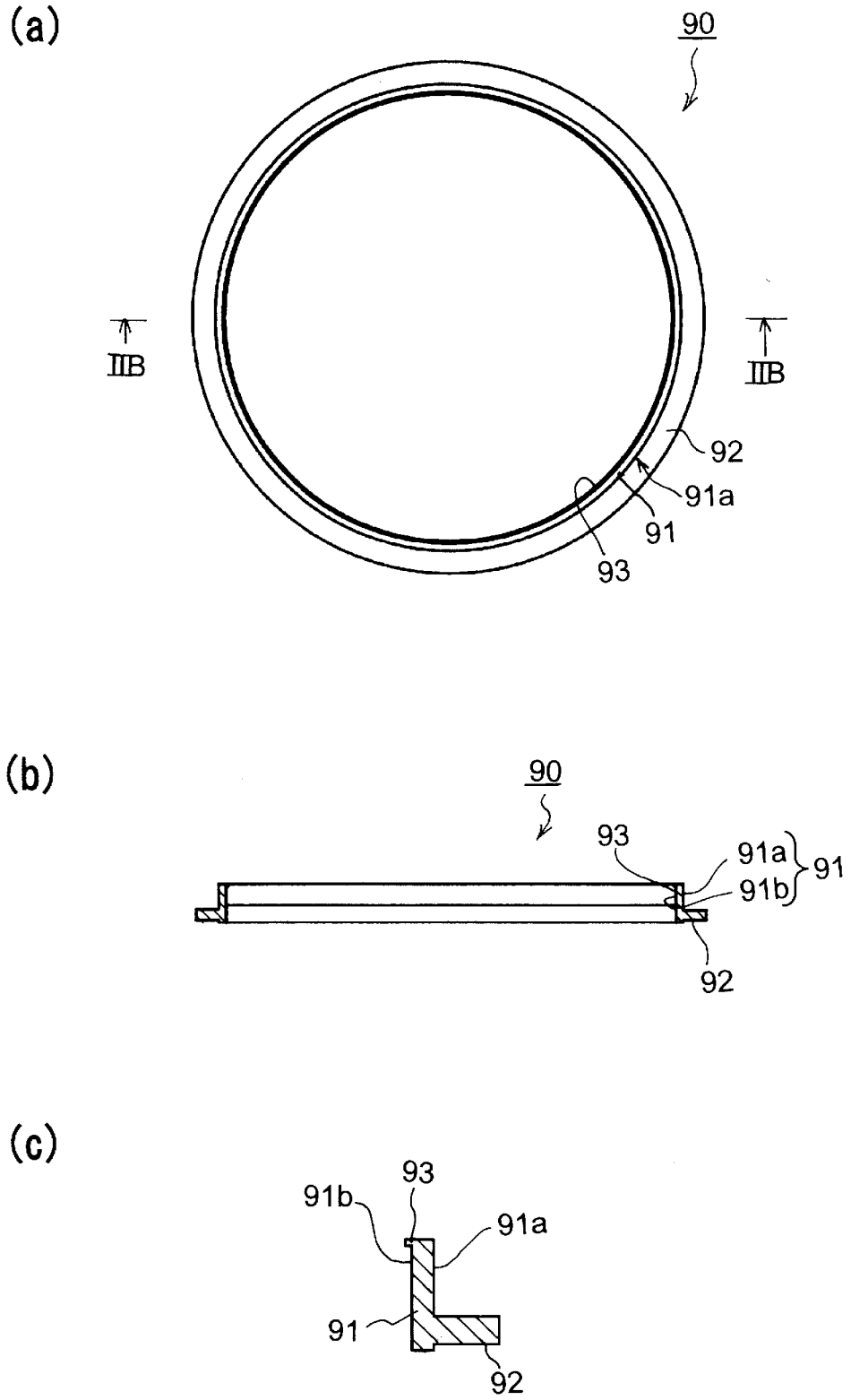
Figure 3:
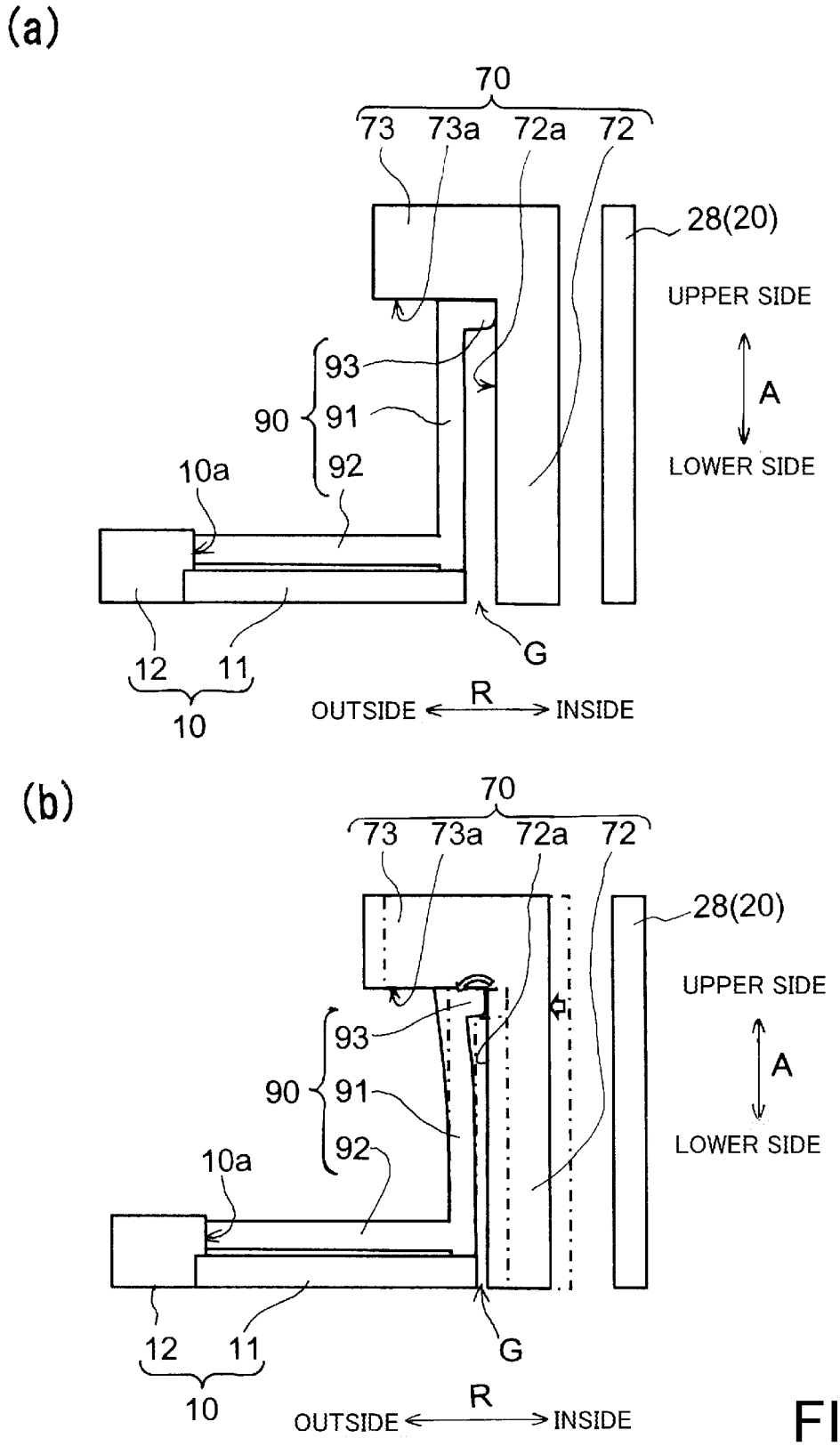
Figure 4:
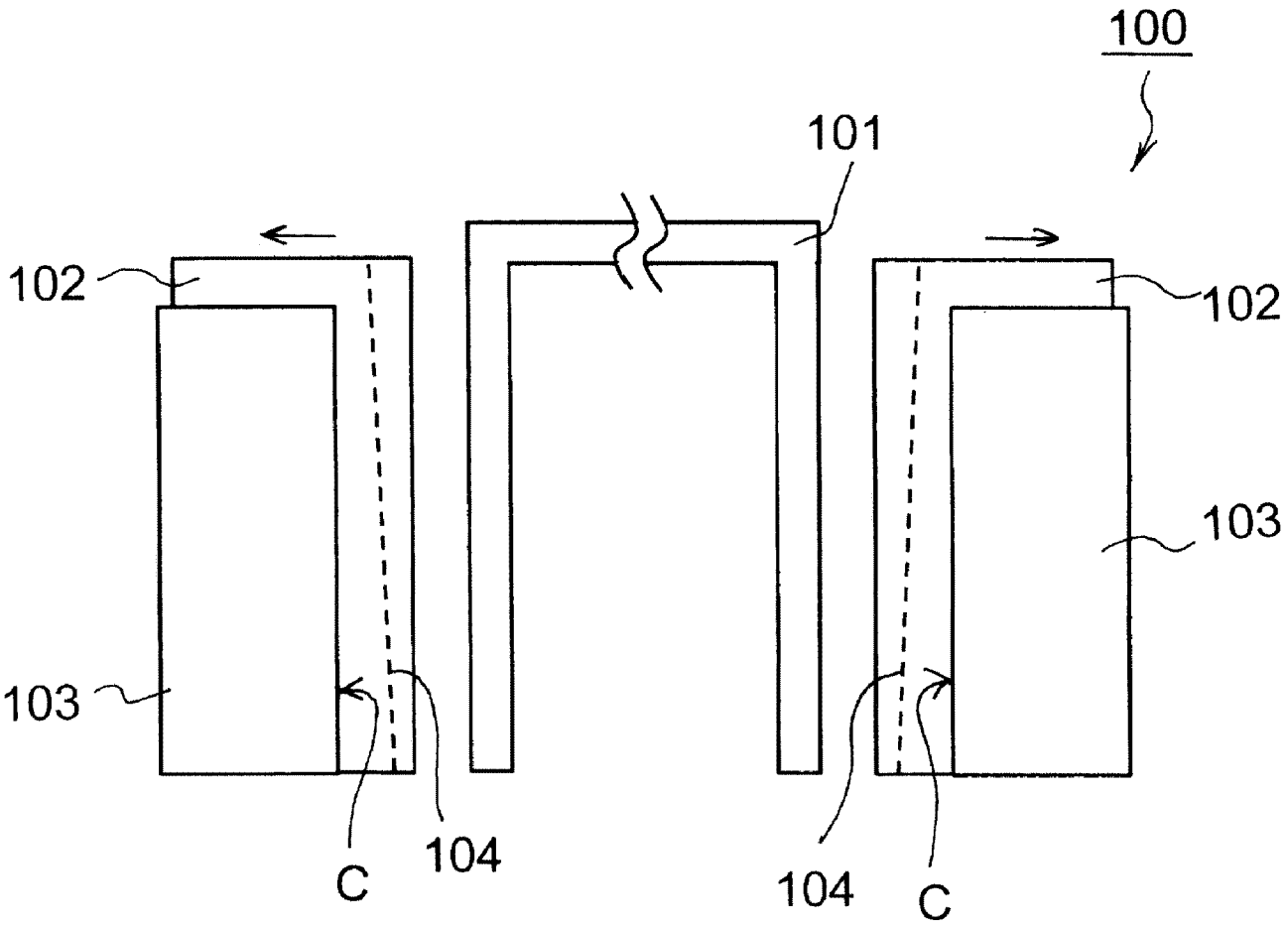
FIG. 4 is a schematic diagram showing assemblage of a casing and a stator that is applied to a conventional vacuum pump.

A vacuum pump according to a first embodiment of the present invention is described hereinafter with reference to FIGS. 1 to 3. In the following description, such terms as "top/upper" and "bottom/lower" correspond to the upper side and the lower side in a vertical direction.

A vacuum pump 1 is a combination pump comprising a turbomolecular pump mechanism PA and a thread groove pump mechanism PB, which are stored in a substantially cylindrical casing 10.

The vacuum pump 1 has the casing 10, a rotor 20 having a rotor shaft 21 supported rotatably in the casing 10, a drive motor 30 for rotating the rotor shaft 21, and a stator column 40 for storing a part of the rotor shaft 21 and the drive motor 30.

The casing 10 is formed into a bottomed cylinder. The casing 10 is configured with a base 11 having a gas outlet port 11*a* on the side of a lower portion thereof, and a cylinder portion 12 having a gas inlet port 12*a* in an upper portion thereof and mounted and fixed onto the base 11 by a bolt 13. Note that reference numeral 14 shown in FIG. 1 represents a back lid.

The base 11 has a heater, not shown, which is embedded in the base 11. The heater keeps the temperature of the base 11 at a predetermined temperature (e.g., 80° C.) by means of temperature adjusting means, not shown.

The cylinder portion 12 is attached to a vacuum container such as a chamber, not shown, with a flange 12*b* therebetween. The gas inlet port 12*a* is connected to the vacuum container, and the gas outlet port 11*a* is connected in a communicable manner to an auxiliary pump, not shown.

The rotor 20 has the rotor shaft 21 and rotor blades 22 that are fixed to an upper portion of the rotor shaft 21 and arranged concentrically with respect to the shaft center of the rotor shaft 21.

The rotor shaft 21 is supported in a non-contact manner by a magnetic hearing 50. The magnetic bearing 50 has a radial electromagnet 51 and an axial electromagnet 52. The radial electromagnet 51 and the axial electromagnet 52 are connected to a control unit, not shown.

The control unit controls excitation currents of the radial electromagnet 51 and the axial electromagnet 52 based on detection values obtained by a radial direction displacement sensor 51*a* and an axial direction displacement sensor 52*a*, whereby the rotor shaft 21 is supported afloat at a predetermined position.

The upper and lower portions of the rotor shaft 21 are inserted into touchdown bearings 23. When the rotor shaft 21 is uncontrollable, the rotor shaft 21, rotating at high speed, comes into contact with the touchdown bearings 23, preventing damage to the vacuum pump 1.

The rotor blades 22 are attached integrally to the rotor shaft 21 by inserting bolts 25 into a rotor flange 26 and screwing the bolts 25 into a shaft flange 27 while having the upper portion of the rotor shaft 21 inserted into a boss hole 24. Hereinafter, the axial direction of the rotor shaft 21 is referred to as "rotor axial direction A" of the rotor 20, and the radial direction of the rotor shaft 21 is referred to as "rotor radial direction R" of the rotor 20.

The drive motor 30 is configured with a rotator 31 attached to the outer circumference of the rotor shaft 21 and a stationary part 32 surrounding the rotator 31. The stationary part 32 is connected to the abovementioned control unit, not shown, which controls the rotation of the rotor 20.

The stator column 40 is placed on the base 11 and has a lower end portion fixed to the base 11 by a bolt 41.

The turbomolecular pump mechanism PA that is disposed in approximately the upper half of the vacuum pump 1 is described next.

The turbomolecular pump mechanism PA is configured with the rotor blades 22 of the rotor 20 and stator blades 60 disposed with gaps with the rotor blades 22. The rotor blades 22 and the stator blades 60 are arranged alternately in multiple stages along a vertical direction H. In the present embodiment, five stages of the rotor blades 22 and four stages of the stator blades 60 are arranged.

The rotor blades 22 are inclined at a predetermined angle and formed integrally on an upper outer circumferential surface of the rotor 20. The plurality of the rotor blades 22 are also installed radially around the axis of the rotor 20.

The stator blades 60 are inclined in the opposite direction from the rotor blades 22 and each sandwiched, in the vertical direction H, by spacers 61 that are installed in a stacked manner on an inner wall surface of the cylinder portion 12. The plurality of stator blades 60, too, are installed radially around the axis of the rotor 20.

The gaps between the rotor blades 22 and the stator blades 60 are configured to become gradually narrow from the upper side to the lower side in the vertical direction H. The lengths of the rotor blades 22 and the stator blades 60 are configured to become gradually short from the upper side to the lower side in the vertical direction H.

In the turbomolecular pump mechanism PA described above, gas that is drawn through the gas inlet port 12*a* is transferred from the upper side to the lower side in the vertical direction H by means of the rotation of the rotor blades 22.

The thread groove pump mechanism PB that is disposed in approximately the lower half of the vacuum pump 1 is described next.

The thread groove pump mechanism PB has a rotor cylinder portion 28 provided in the lower portion of the rotor 20 and extended along the vertical direction H, a substantially cylindrical outer circumferential stator 70 surrounding an outer circumferential surface 28*a* of the rotor cylinder portion 28, and a substantially cylindrical inner circumferential stator 80 disposed on the inside of the rotor cylinder portion 28.

The outer circumferential surface 28*a* and an inner circumferential surface 28*b* of the rotor cylinder portion 28 are each formed into a flat cylindrical surface. The outer circumferential surface 28*a* of the rotor cylinder portion 28 faces an inner circumferential surface 70*a* of the outer circumferential stator 70 with a predetermined gap therebetween, the inner circumferential surface 70*a* being configured as an opposing surface to oppose the outer circumferential surface 28*a* of the rotor cylinder portion 28. The inner circumferential surface 28*b* of the rotor cylinder portion 28 faces an outer circumferential surface 80*a* of the inner circumferential stator 80 with a predetermined gap therebetween, the outer circumferential surface 80*a* being configured as an opposing surface to oppose the inner circumferential surface 28*b* of the rotor cylinder portion 28.

The outer circumferential stator 70 is placed on the base 11, with a heat insulating spacer 90 described hereinafter therebetween, and is also fixed to the base 11 by a bolt, not shown. The outer circumferential stator 70 has an outer circumferential thread groove portion 71 engraved on the inner circumferential surface 70*a*. The outer circumferential stator 70 has a small-diameter cylinder portion 72 that is stored in the base 11 by means of an insert, and a large-diameter cylinder portion 73 that is stored in the cylinder portion 12 by means of an insert.

The inner circumferential stator 80 is fixed to the base 11 by bolts 15. The inner circumferential stator 80 has an inner circumferential thread groove portion 81 engraved on the outer circumferential surface 80*a*.

In the thread groove pump mechanism PB described above, the gas that is transferred from the gas inlet port 12*a* to the lower side in the vertical direction H is compressed by the drag effect of high-speed rotation of the rotor cylinder portion 28 and is then transferred toward the gas outlet port 11*a*.

Specifically, the gas is compressed in the outer circumferential thread groove portion 71 and then transferred to the gas outlet port 11*a* after being transferred to the gap between the rotor cylinder portion 28 and the outer circumferential stator 70, or is compressed by the inner circumferential thread groove portion 81 and then transferred to the gas outlet port 11*a* after being transferred to the gap between the rotor cylinder portion 28 and the inner circumferential stator 80 via a communication hole 29.

A specific configuration of the heat insulating spacer 90 is described next with reference to FIGS. 2A, 2B and 2C.

The heat insulating spacer 90 is made of stainless steel and has thermal conductivity that is lower than those of the aluminum casing 10 and the outer circumferential stator 70. The specific material of the heat insulating spacer 90 may be any material as long as it has thermal conductivity lower than that of the outer circumferential stator 70 or the base 11. Preferably, the material of the heat insulating spacer 90 has thermal conductivity lower than those of the outer circumferential stator 70 and the base 11.

The heat insulating spacer 90 has an axial supporting portion 91 having a substantially cylindrical shape, a first radial supporting portion 92 provided circumferentially on an outer circumferential surface 91*a* of the axial supporting portion 91, and a second radial supporting portion 93 provided circumferentially on an inner circumferential surface 91*b* of the axial supporting portion 91.

The axial supporting portion 91 extends along the axial direction matching the rotor axial direction A. The axial supporting portion 91 is made thinner than the first radial supporting portion 92 and less rigid than the first radial supporting portion 92.

The first radial supporting portion 92 is disposed on the lower end side of the axial supporting portion 91 and extends from the outer circumferential surface 91*a* in a flange-like manner. Note that the first radial supporting portion 92 is preferably disposed with a small gap with a lower end 91*c* of the axial supporting portion 91. Such a configuration brings the heat insulating spacer 90 and the base 11 into contact with each other by a reduced area. In other words, the area of contact between the first radial supporting portion 92 and the base 11 is small because a part of the first radial supporting portion 92 comes into contact with the base 11, preventing the escape of heat from the heat insulating spacer 90 to the base 11.

The second radial supporting portion 93 is disposed on the upper end side of the axial supporting portion 91. In the present embodiment, the second radial supporting portion 93 is provided upright on the inner circumferential surface 91*b* at the upper end of the axial supporting portion 91. The length of the second radial supporting portion 93 is set within the range that enables securing of a gap G between the base 11 and the small-diameter cylinder portion 72, as described hereinafter.

The actions of the heat insulating spacer 90 entailed in thermal expansion and enlargement of the outer circumferential stator 70 are described next with reference to FIGS. 3A and 3B. For the purpose of enabling easy understanding of the features of the present application, FIGS. 3A and 3B each exaggeratedly illustrate the length of the second radial supporting portion 93.

As shown in FIG. 3A, with the gap G provided between the base 11 of the casing 10 and the small-diameter cylinder portion 72 of the outer circumferential stator 70, the first radial supporting portion 92 is in contact with an inner circumferential surface 10*a* of the casing 10, and the second radial supporting portion 93 is in contact with an outer circumferential surface 72*a* of the small-diameter cylinder portion 72. Thus, the outer circumferential stator 70, positioned coaxially with the rotor 20, is stored in the casing 10 by means of an insert.

The axial supporting portion 91 is held between a bottom surface 73*a* of the large-diameter cylinder portion 73 functioning as a supported portion of the outer circumferential stator 70 and a top surface 11*b* of the base 11, to support the outer circumferential stator 70 in the rotor axial direction A. Note that the axial supporting portion 91 is in the shape of a straight line along the rotor axial direction A prior to running the vacuum pump 1.

Once the vacuum pump 1 is run, the heat generated by the rotor 20 and the drive motor 30 increases the temperature of the rotor cylinder portion 28 (e.g., 130° C.). As a result, the outer circumferential stator 70 receives the heat radiated from the rotor cylinder portion 28, has its temperature increased gradually, and begins to thermally expand toward the outside along the rotor radial direction R.

Once the outer circumferential stator 70 is thermally expanded and enlarged, the second radial supporting portion 93 receives outer pressing force of the rotor radial direction R and, as shown in FIG. 3B, the axial supporting portion 91 bends toward the outside in the rotor radial direction R, with the first radial supporting portion 92 as a supporting point. Before and after the thermal expansion of the outer circumferential stator 70, the second radial supporting portion 93 continues to support the outer circumferential stator 70 in the rotor radial direction R, keeping the outer circumferential stator 70 disposed coaxially with the rotor 20.

When the second radial supporting portion 93 bends toward the outside in the rotor radial direction R, the presence of the gap G between the base 11 and the outer circumferential stator 70 can prevent a significant decrease in the thermal resistance on the contact surface between the casing 10 and the outer circumferential stator 70, which can be caused when the outer circumferential stator 70 adheres tightly to the base 11 at high contact pressure. Consequently, the heat of the outer circumferential stator 70 can be prevented from escaping to the casing 10 via the heat insulating spacer 90.

Moreover, because the thermal conductivity of the heat insulating spacer 90 is set to be lower than those of the casing 10 and the outer circumferential stator 70, the heat from the outer circumferential stator 70 is less likely to enter the heat insulating spacer 90, preventing the escape of heat of the outer circumferential stator 70.

In addition, by forming the heat insulating spacer 90 to have a roughly L-shaped cross section, the heat transfer path inside the heat insulating spacer 90 can be lengthened, further preventing the escape of the heat from the outer circumferential stator 70 to the casing 10.

Therefore, in the vacuum pump where, for example, the temperature of the base 11 is controlled to 80° C. and the temperature of the rotor 20 is increased to at least 130° C., if the outer circumferential stator is stored in the casing while in direct contact therewith as in the prior art, there would be a risk that the temperature of the outer circumferential stator drops to 100° C. to fall below the sublimation point of the gas, but if the outer circumferential stator 70 is stored in the casing 10 with the heat insulating spacer 90 therebetween, the temperature of the outer circumferential stator 70 would be stable at approximately 110° C. or higher and therefore kept at the sublimation point of the gas or higher.

In this manner, the heat insulating spacer 90 according to the present embodiment prevents the heat from the outer circumferential stator 70 from escaping to the casing 10 while supporting the outer circumferential stator 70 in the casing 10 in the rotor radial direction R. Accordingly, the temperature of the outer circumferential stator 70 can easily be kept at not lower than the sublimation point of the gas transferred through the outer circumferential thread groove portion 71, preventing the solidification and deposition of the gas in the outer circumferential thread groove portion 71.

Although the outer circumferential thread groove portion is provided on the inner circumferential surface of the outer circumferential stator in the foregoing embodiment, the outer circumferential thread groove portion may be provided on the outer circumferential surface of the rotor cylinder portion.

However, the present invention can be applied to any vacuum pump equipped with the thread groove pump mechanism and is therefore applicable to thread groove-type pumps in addition to combination pumps.

It should be noted that the present invention can be modified in various ways without departing from the spirit of the present invention, and that needless to say the present invention contains all such modifications.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a casing;

a rotor that is supported rotatably in the casing and has a rotor cylinder portion;

a stator having a substantially cylindrical shape, disposed coaxially with the rotor between the casing and the rotor cylinder portion;

a thread groove portion engraved on either an outer circumferential surface of the rotor cylinder portion or an inner circumferential surface of the stator; and a heat insulating spacer that is interposed between the casing and the stator, supports the stator in a rotor radial direction, with keeping a gap between the casing and the stator, and has lower thermal conductivity than at least either the casing or the stator, wherein the casing has:

a cylinder portion; and a base provided under the cylinder portion, and the heat insulating spacer has:

an axial supporting portion having a substantially cylindrical shape, extended along a rotor axial direction and interposed between the base and a supported portion provided circumferentially on an outer circumferential surface of the stator;

a first radial supporting portion provided circumferentially on an outer circumferential surface of the axial supporting portion and coming into contact with an inner circumferential surface of the casing; and a second radial supporting portion provided circumferentially on an inner circumferential surface of the axial supporting portion and coming into contact with the outer circumferential surface of the stator, and the axial supporting portion bends in the rotor radial direction.

2. The vacuum pump according to claim 1, wherein the heat insulating spacer supports the stator also in the rotor axial direction.

3. The vacuum pump according to claim 2, wherein the first radial supporting portion is disposed on one end side of the axial supporting portion, and the second radial supporting portion is disposed on the other end side of the axial supporting portion.

4. The vacuum pump according to claim 2, wherein the axial supporting portion is formed to have lower rigidity than the first radial supporting portion.

5. The vacuum pump according to claim 2, wherein one end of the axial supporting portion is stretched farther downward from the first radial supporting portion in the rotor axial direction and comes into contact with the base.

6. The vacuum pump according to claim 1, wherein the first radial supporting portion is disposed on one end side of the axial supporting portion, and the second radial supporting portion is disposed on the other end side of the axial supporting portion.

7. The vacuum pump according to claim 6, wherein the axial supporting portion is formed to have lower rigidity than the first radial supporting portion.

8. The vacuum pump according to claim 6, wherein one end of the axial supporting portion is stretched farther downward from the first radial supporting portion in the rotor axial direction and comes into contact with the base.

9. The vacuum pump according to claim 1, wherein the axial supporting portion is formed to have lower rigidity than the first radial supporting portion.

10. The vacuum pump according to claim 9, wherein one end of the axial supporting portion is stretched farther downward from the first radial supporting portion in the rotor axial direction and comes into contact with the base.

11. The vacuum pump according to claim 1, wherein one end of the axial supporting portion is stretched farther downward from the first radial supporting portion in the rotor axial direction and comes into contact with the base.

* * * * *